US006264076B1

(12) United States Patent
Stocchiero

(10) Patent No.: US 6,264,076 B1
(45) Date of Patent: Jul. 24, 2001

(54) CLOTHES HANGER

(76) Inventor: Olimpio Stocchiero, Via Kennedy, 5-36050, Montorso Vicentino (VI) (IT)

( * ) Notice: Subject to any disclaimer, the term of this patent is extended or adjusted under 35 U.S.C. 154(b) by 0 days.

(21) Appl. No.: 09/519,616

(22) Filed: Mar. 6, 2000

(30) Foreign Application Priority Data

Mar. 11, 1999 (IT) ..... VI99U0020

(51) Int. Cl.[7] ..... A47G 25/14
(52) U.S. Cl. ..... 223/85
(58) Field of Search ..... 223/85, 92, 95, 223/88

(56) References Cited

U.S. PATENT DOCUMENTS

| | | | | |
|---|---|---|---|---|
| 834,652 | * | 10/1906 | Barrell et al. | 223/85 |
| 2,150,869 | * | 3/1939 | Shafarman | 223/92 |
| 2,912,149 | * | 11/1959 | Stuard | 223/85 |
| 3,168,970 | * | 2/1965 | Wilson | 223/92 |
| 3,425,604 | | 2/1969 | Mauldin . | |
| 4,029,239 | | 6/1977 | Dolan . | |
| 4,157,776 | | 6/1979 | Dolan . | |
| 4,714,183 | * | 12/1987 | Tontarelli | 223/91 |
| 4,895,283 | * | 1/1990 | Evangelist et al. | 223/94 |
| 5,170,916 | * | 12/1992 | Kolton et al. | 223/92 |

FOREIGN PATENT DOCUMENTS

| | | |
|---|---|---|
| 570445 | 9/1958 | (BE) . |
| 693766 | 11/1930 | (FR) . |

* cited by examiner

*Primary Examiner*—Bibhu Mohanty
(74) *Attorney, Agent, or Firm*—Dykema Gossett PLLC

(57) ABSTRACT

The finding provides a hanger made of plastic, including a main body substantially symmetrical to a central part holding the support hook, said body having two arms sloping down from the center towards their ends. Said hanger has a mass of first flexible elements, protruding from the upper surface of said arms and incorporated in said arms during the molding of the hanger such that they prevent the hanging garments from slipping.

9 Claims, 4 Drawing Sheets

CLOTHES HANGER

This finding refers to a clothes hanger for hanging garments, specially adapted to prevent them from slipping.

It is known that on the market there is a wide variety of clothes hangers for hanging clothes, which in trade jargon are called "hangers" for short; this term shall therefore be used in the description that follows.

Known hangers involve a main body, substantially symmetrical to their central part, which holds a hook to support the hanger.

The main body has two arms sloping down from the centre to the ends, with a cut suitable for supporting the shoulders, or the top part of various garments in general.

In many types of known hangers, the aforementioned ends of the arms are joined by an cross rod that allows to hang trousers, skirts and similar.

One inconvenience found in the older types of hangers, made of wood, metal or smooth plastic, was that the hanging clothes tended to slip.

To avoid said inconvenience hangers have recently been made with the tops of the arms and cross rod provided with a rough surface, impressed by various patterns.

In particular, the most widespread hangers made by means of plastic moulding obtained the roughness on said surfaces by a special process, called "flocculation" of the plastic.

This process ensures a specific friction between the hanger and the surface of the fabric put against it, reducing the complaint of clothes slipping.

Other types of hanger have provided the surfaces in contact with the clothes with strips of velvety material glued to the top of the hangers arms and rod.

Even this solution ensures a specific adherence on the hanging clothes, but only in normal conditions of use that do not cover vibrations or sharp movements.

In special conditions of use, such as transporting garments by vehicles that undergo vibrations and abrupt changes in directions, the known hangers do not ensure sufficient stability to the garments being hung.

Furthermore extensive use, and therefore wear, as well as the inevitable hardening process of the plastic, progressively reduce the adherence ensured by the flocculated surfaces, increasing the risk of the garments slipping.

The same can be said for the strips of velvety material, which also have an inconvenience in their construction, having to be applied to the hanger in a second stage after the moulding phase.

This finding intends to remedy the aforementioned inconveniences.

In particular the first scope of the finding is to produce a hanger that prevents the garments they hold from slipping, even in particularly critical conditions of use.

Another scope of the finding is to avoid additional production processes to the moulding, phases which are at times necessary to increase the adherence of the surfaces in contact with the clothes being hung.

The scopes described are achieved by creating a hanger in plastic including a main body, substantially symmetrical to its central part holding the support hook, said body having two arms sloping down from the centre to their ends, joined by a cross rod, wherein they have a mass of first flexible elements, protruding from the upper surface of said arms, and a mass of second flexible elements, protruding from the upper surface of said rod, said first and second flexible elements being incorporated in said arms and rod during the moulding of the hanger, and being provided to prevent the hanging garments from slipping.

According to a preferred form of production, the flexible elements incorporated in the arms of the hanger are composed of thin reeds set in substantially parallel lines to one another and perpendicular to the lengths of the actual arms.

According to the same preferred form of production, the flexible elements incorporated in the cross rod of the hanger are thin straight reeds running parallel to the length of the rod.

According to an execution variant the flexible elements incorporated in the arms of the hanger are a mass of pairs of reed segments, arranged in a herringbone form on the upper surface of the arms.

According to another execution variant these flexible elements on the arms are series of reed segments arranged in arches on the same surface. According to yet another execution variant said flexible elements on the arms are wavy reeds substantially parallel to one another.

According to a final example of a possible execution variant of the finding, said flexible elements on the arms are a mass of small protrusions, uniformly distributed on said surfaces.

The aforementioned scopes and advantages shall be better illustrated during the description of a preferred form of execution of the finding and of some of its execution variants, given as a guideline but not a limitation and illustrated in the attached diagrams, where:

Figure 1:
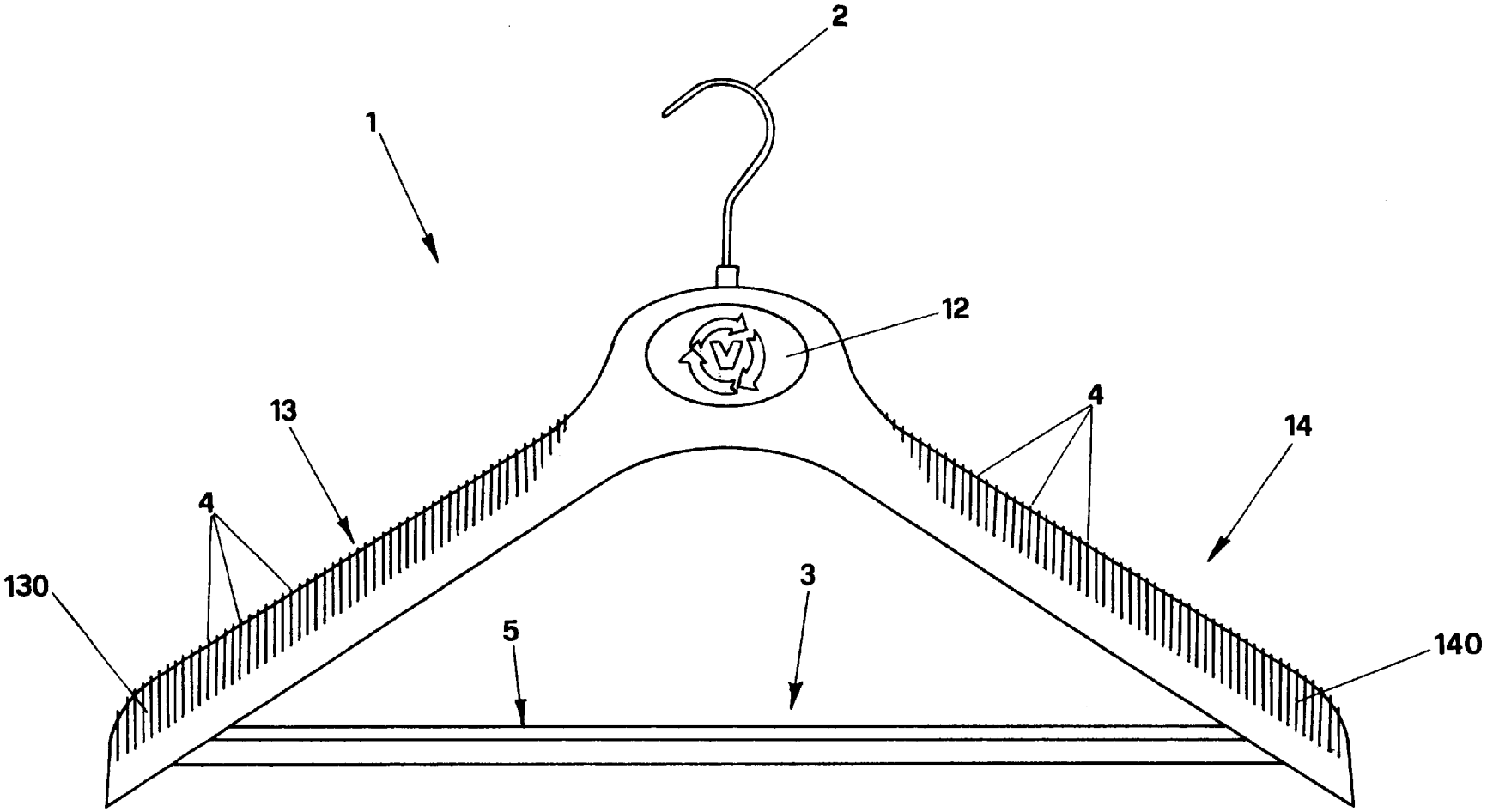
FIG. 1 shows a front view of the hanger of the finding.

As seen in FIG. 1, the hanger of the finding includes the main body 1, substantially symmetrical to its central part 12, which holds the support hook 2 of the hanger.

Said main body includes two arms 13 and 14, sloping down from the centre to their ends 130 and 140.

These ends are internally joined by a cross rod 3 that contributes to rendering the structure of the hanger's main body rigid and allows the hanging of garments, such as trousers, skirts and similar.

Figure 2:
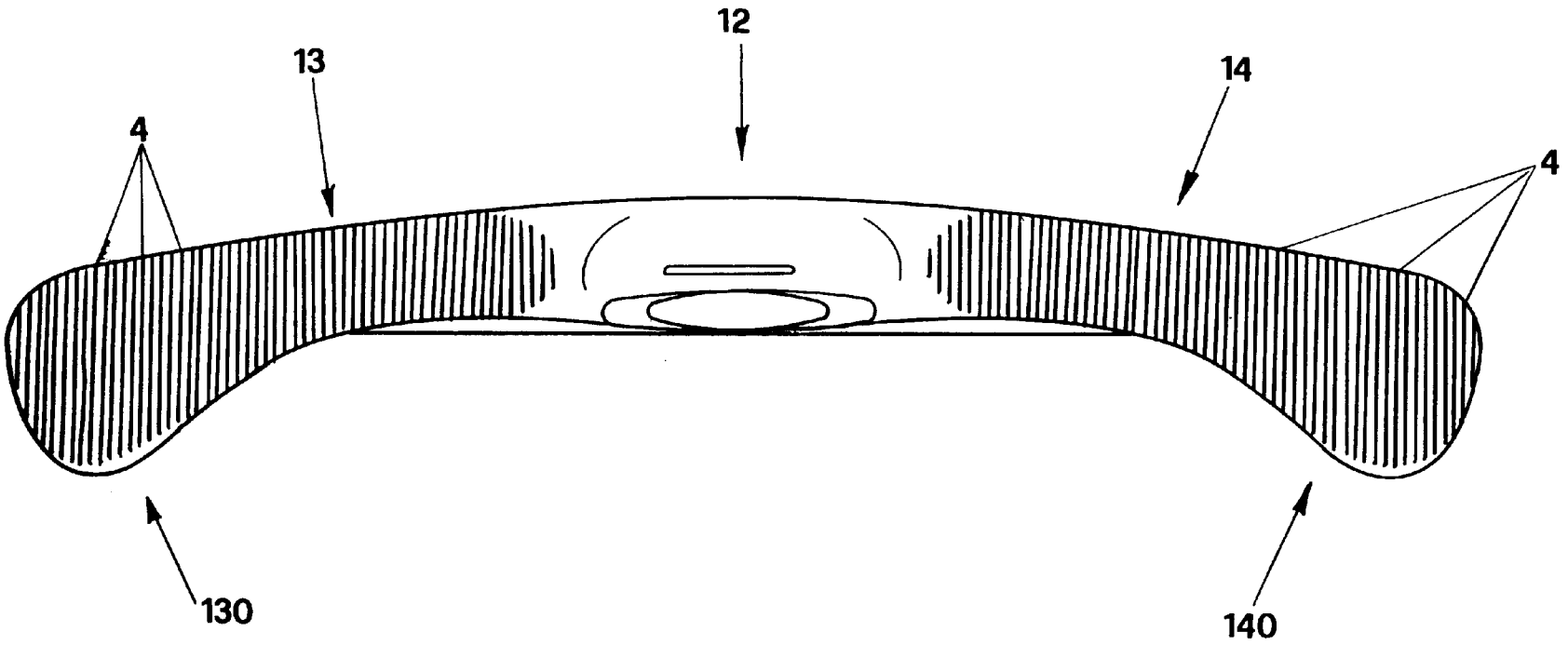
FIG. 2 shows an aerial view of the same hanger.
Figure 3:
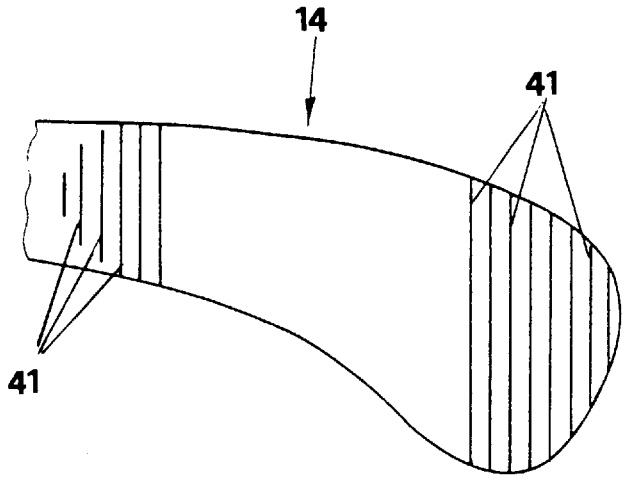
FIG. 3 shows the detail of one of the arms of the same hanger seen from above.
Figure 4:
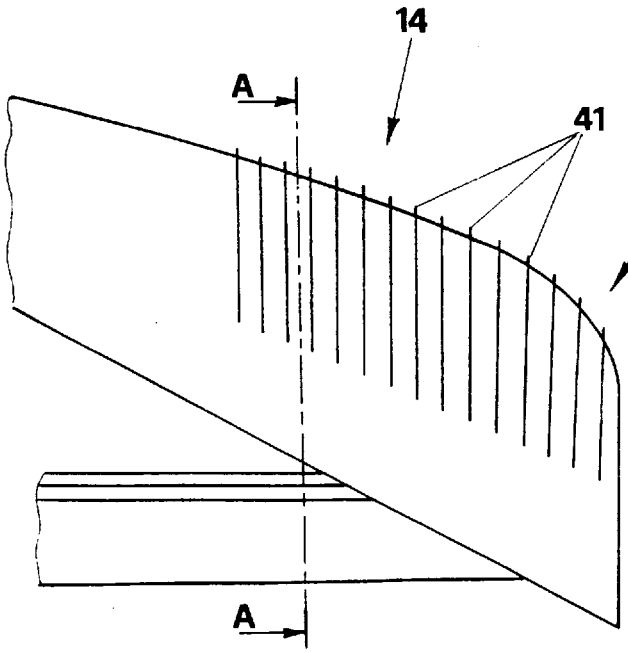
FIG. 4 shows the front view of the same detail as FIG. 3.
Figure 5:
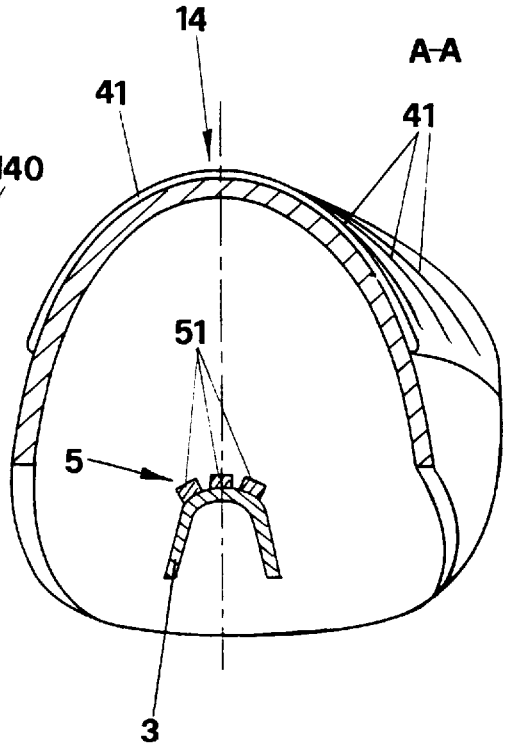
FIG. 5 shows the same detail from a section perpendicular to the length of the hanger.

The same ends 130 and 140, as seen with more detail in FIG. 2, have a widened, forward curving form with respect to the more central part of the arms, so that they are better adapted to the inside of the shoulders of garments being hung, such as: jackets, shirts, coats and similar.

In order to prevent the hanging clothes from slipping on the surface of each arm, this surface is provided with a mass of first flexible elements 4, running crossways to the length of the arm and protruding upwards from its surface by a small distance.

There are similar second protruding flexible elements 5, with the same scope, on the upper surface of the cross rod 3 (FIG. 1).

As seen with more detail in FIGS. 3 to 6, said first flexible elements of each arm are composed of a group of reeds 41 set parallel to one another and running crossways along nearly all the upper surface of the arm 14.

In a similar manner, the aforementioned second flexible elements of the rod are composed of several straight reeds 51 running parallel to the length of the rod.

Said first and second flexible elements on their respective upper surfaces of the arms and rod can have any kind of form, dimensions and distribution.

Figure 6:
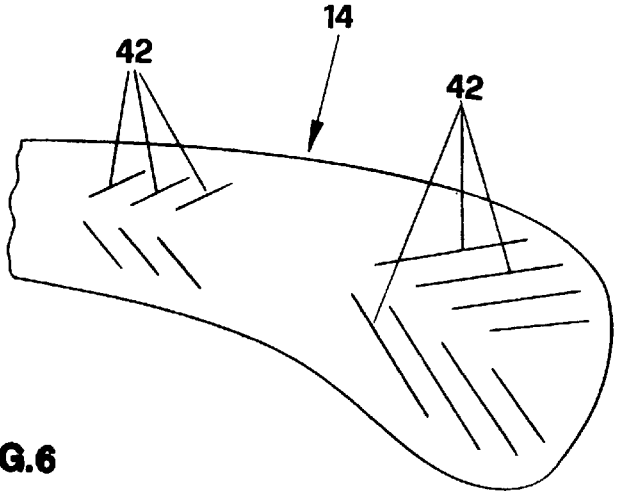
FIG. 6 shows a first execution variant of the upper surface of the hanger's arms.

A first example of execution variant of the upper surface of each arm is illustrated in FIG. 6, which shows said first flexible elements 4 made in pairs of reed segments 42, the pairs arranged in a herringbone form on the upper surface of the arm 14.

Figure 7:
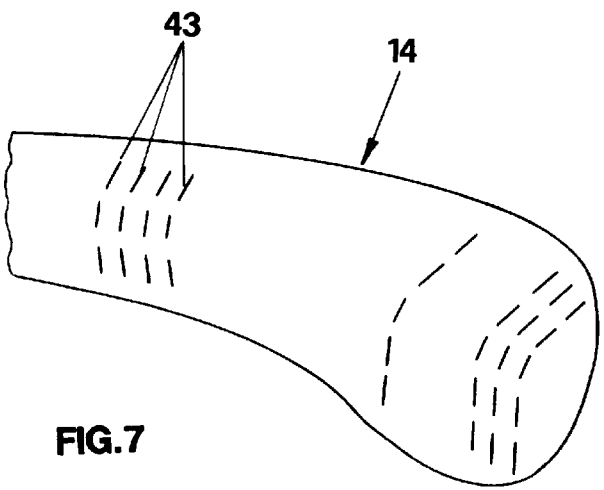
FIG. 7 shows a second execution variant of the same surface.

A second execution variant of said surface can be seen in FIG. 7 where said first flexible elements are composed of series of reed segments 43, arranged in substantially parallel arches.

Figure 8:
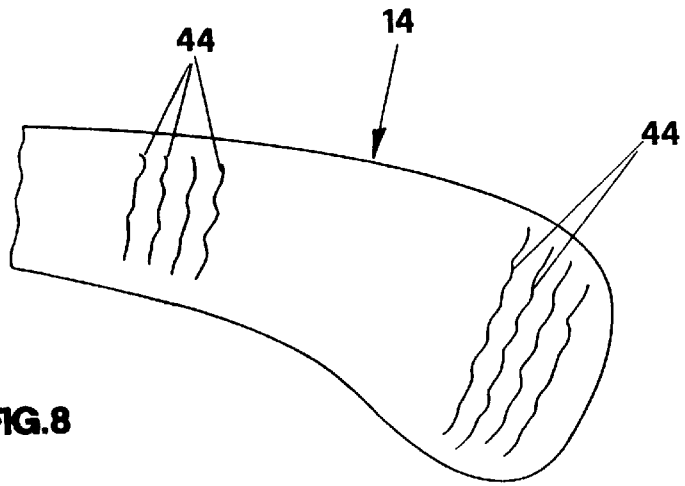
FIG. 8 shows a third execution variant of the same surface.

A third execution variant of the same surface can be seen in FIG. 8 where said first flexible elements are composed of a mass of wavy reeds 44, substantially running in parallel lines.

Figure 9:
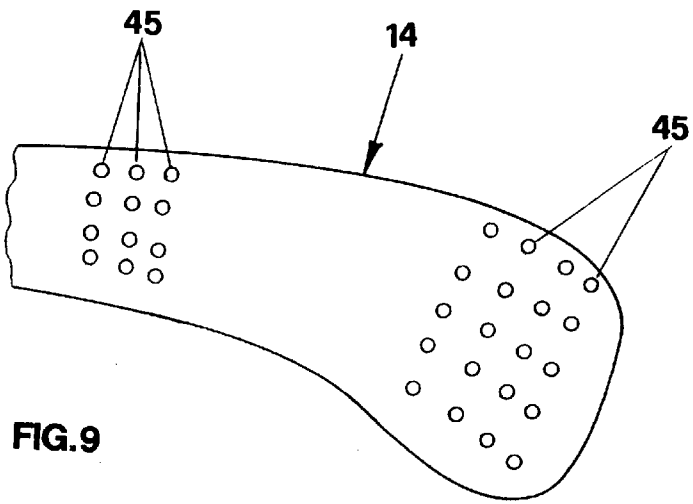
FIG. 9 shows a fourth execution variant of the same surface.

A fourth execution variant of the same surface can finally be seen in FIG. 9 where said first flexible elements are composed of a mass of small protrusions 45, uniformly distributed over said surface.

It is quite clear that similar forms to those described above for said first flexible elements 4 of arms 13 and 14, can also be adopted for the second flexible elements 5 belonging to the cross rod 3.

The flexible elements protruding from the arms and the rod provide the hanging clothes a support surface which is very high rough and ragged.

In fact, lightweight garments dip slightly into the spaces between the individual, adjacent elements increasing the stability of the support, while heavier clothing causes the flexible elements to partially bend increasing the contact surface with the soft reeded surfaces of the actual elements and thereby achieving better adherence.

Said first and second flexible elements are produced during the single moulding phase of the hanger, being incorporated in the main body and the cross rod respectively, during said production process.

By the aforementioned descriptions it is evident that the hanger of the finding achieves all the established scopes and advantages.

What is claimed is:

1. A garment hanger comprising:

a support hook having a free end and a proximal end, a molded plastic rigid body having a front and a rear side including a central portion and a pair of arms having free ends, each arm having an axis and being secured to the central portion and extending axially away therefrom towards the free ends, the support hook being secured to the central portion, said arms having contoured surfaces and a plurality of first flexible elements forming a comb-like arrangement integral with the body and extending from the front to rear along the contoured surfaces, said first flexible elements for engaging the garment in spaced relation with the arms and preventing slippage and snagging thereof relative to the hanger, said first flexible elements being bendable side to side in an axial direction of the arms, said body having a cross rod extending between and attached to said free end of each said arm, a plurality of second flexible elements being formed on said cross rod, extending substantially the length of said cross rod and being parallel therewith.

2. The hanger of claim 1, wherein the contoured surfaces of the arms extend forward of the support hook, each having a rear surface formed with a uniformly contoured convex surface having a first curvature and a front surface formed with inner arcuate portions having a first concave curvature and outer convex portions near the free ends having a second convex curvature, said second curvature having a radius of curvature greater than the first convex surface and the concave surface.

3. Hanger according to claim 1, wherein said first flexible elements are composed of thin reeds set on substantially parallel lines one to another and perpendicular to the length of said arms.

4. Hanger according to claim 1, wherein said first flexible elements are a mass of pairs of reed segments, arranged in a herringbone form.

5. Hanger according to claim 1, wherein said first flexible elements are series of reed segments arranged in arches.

6. Hanger according to claim 1, wherein said first flexible elements are wavy reeds substantially parallel to one another.

7. Hanger according to claim 1, wherein said first flexible elements are a mass of small protrusions distributed over the upper surface of said arms.

8. Hanger according to claim 1, wherein said second flexible elements protrude from the upper surface of said cross rod and are incorporated in said cross rod during moulding, said second flexible elements prevent the hanging garments from slipping.

9. Hanger according to claim 1, wherein said second flexible elements are thin straight reeds.

* * * * *